US007566183B2

(12) United States Patent
Shoji et al.

(10) Patent No.: US 7,566,183 B2
(45) Date of Patent: Jul. 28, 2009

(54) IMAGE FORMING DEVICE COMPRISING MEANS FOR ADJUSTING A POSITION OF A PLURALITY OF PRESS ROLLERS

(75) Inventors: Katsushi Shoji, Kyoto (JP); Hideatsu Shimamoto, Otsu (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 475 days.

(21) Appl. No.: 11/483,294

(22) Filed: Jul. 6, 2006

(65) Prior Publication Data

US 2007/0009308 A1 Jan. 11, 2007

(30) Foreign Application Priority Data

Jul. 7, 2005 (JP) ..... 2005-198453

(51) Int. Cl.
*B41J 13/042* (2006.01)

(52) U.S. Cl. ..... 400/625; 347/104; 271/274

(58) Field of Classification Search ..... None
See application file for complete search history.

(56) References Cited

U.S. PATENT DOCUMENTS

| | | | | |
|---|---|---|---|---|
| 3,964,739 | A * | 6/1976 | Garcia | 271/274 |
| 4,821,049 | A * | 4/1989 | Eckl | 271/274 |
| 5,653,439 | A | 8/1997 | Rider et al. | |
| 6,644,875 | B1 * | 11/2003 | Sakaino et al. | 400/625 |
| 7,210,680 | B2 * | 5/2007 | Yoneda et al. | 271/274 |
| 2004/0164485 | A1 * | 8/2004 | Yoneda et al. | 271/274 |

FOREIGN PATENT DOCUMENTS

| | | | |
|---|---|---|---|
| JP | 02144363 | A | 6/1990 |
| JP | 03-088672 | | 4/1991 |
| JP | 03186558 | A | 8/1991 |
| JP | 05319657 | A | 12/1993 |
| JP | 06-148984 | | 5/1994 |
| JP | 09194103 | A | 7/1997 |
| JP | 2002-326753 | | 11/2002 |

OTHER PUBLICATIONS

Japanese language office action and its English language translation for corresponding Japanese application 2005198453 lists the references above.

* cited by examiner

*Primary Examiner*—Jill E. Culler
(74) *Attorney, Agent, or Firm*—Hogan & Hartson LLP

(57) ABSTRACT

A paper output mechanism includes a supporting frame supporting a rotational shaft on which output rollers are fixed. Pressing rollers are fixed at an intermediate position between the output rollers. A guide cover is mounted on the supporting frame. Supporting frame portions are mounted on a side edge of the guide cover opposing to the output rollers, and support the press rollers. The supporting frame portions are fit and held in slits formed on the guide cover. Accordingly, a position adjustment can be performed by moving the supporting frame portions in a paper output direction.

9 Claims, 6 Drawing Sheets

IMAGE FORMING DEVICE COMPRISING MEANS FOR ADJUSTING A POSITION OF A PLURALITY OF PRESS ROLLERS

BACKGROUND OF THE INVENTION

1. Field of the Invention

The present invention relates to an image forming device such as a copier, a printer and a facsimile machine.

2. Description of the Related Art

A known electrophotographic image forming device uses a photoconductive drum as an image carrier. The image forming device forms an electrostatic latent image on a surface of the image carrier, and adheres toner onto the electrostatic latent image to form a visible image. Then, the image forming device transfers the toner image onto paper. In such an image forming device, in general, paper is transported from a paper feed unit to a printer unit, and the printer unit performs an image forming process on the paper. Then, the paper is output onto an output tray. Depending on the environment, the paper may curl while being transported. Thus, there exists a demand for an image forming device which can accurately transport the paper even when the paper curls. In particular, since the paper is heat-processed by a fixing roller after the toner image is transferred onto the paper during the image forming process, when the paper curls it causes an output movement of the paper onto the output tray to be unstable.

A conventional image forming device includes a pair of upper and lower output rollers, a plurality of firmness-providing rollers, and a moving member. The output rollers sandwich the paper after an image has been fixed on the paper, and output the paper. The firmness-providing rollers are movable in an axial direction of the output rollers. The moving member moves the firmness-providing rollers to a position where the firmness-providing rollers provide firmness to the paper according to a kind of the paper to be output. Additionally, a pressing force regulating plate regulates a pressing force between a drive roller and a pressure roller to correct a curl of the paper. By alternately providing film members protruding into a paper transportation path, the firmness of thin paper may be reinforced.

As described above, when the paper curls, an output movement of the paper onto the output tray becomes unstable. Moreover, when curled papers are output onto the output tray, the output papers cannot be stacked neatly. As a result, handling of the papers becomes extremely inconvenient. Such a curl of the paper differs according to a material and/or a size of the paper or even according to an environment. Thus, the curl of the paper is diverse and difficult to uniformly deal with. As described above, conventional image forming devices have dealt with the curl of the paper by adding firmness to the paper. However, this is not sufficient for dealing with various curls of the paper.

SUMMARY OF THE INVENTION

In order to overcome the problems described above, preferred embodiments of the present invention provide an image forming device which can finely handle various curls of paper.

According to a preferred aspect of the present invention, an image forming device transports paper from a paper feed unit to a printer unit, executes an image forming process by the printer unit, and outputs the paper onto an output tray. The image forming device includes a plurality of output rollers, a plurality of press rollers, and a position adjusting member. The output rollers are fixed on a rotational shaft. The press rollers are arranged opposing to the output rollers, respectively. The position adjusting member adjusts a position of the press rollers by moving the press rollers in a paper output direction. The position adjusting member supports the press rollers via an urging member which urges the press rollers against the output rollers. The position adjusting member adjusts the press rollers arranged at both side edges of the output paper to be located upstream of the remaining press rollers in the paper output direction.

Since the image forming device includes the position adjusting member for adjusting the position of the press rollers by moving the press rollers in the paper output direction, the position of the press rollers can be adjusted for each of the press rollers. As a result, the position of each of the press rollers can be adjusted finely according to a feature of a curl of the paper, and an output operation of the press rollers can be carried out stably.

That is, when the press rollers are moved in the paper output direction, the position of the press rollers is adjusted to be located upstream or downstream in the paper output direction. Therefore, a relative positional relation of the press rollers can be set by displacing the press rollers in the paper output direction. For example, when the press rollers arranged at both side edges of the paper are displaced and set at a position located upstream from the remaining press rollers in the paper output direction, a center portion of the paper is slightly pulled in the paper output direction and the center portion of the paper bends. Accordingly, a sufficient firmness can be applied to the paper.

The paper generally curls in the paper output direction. When the center portion of the paper bends such that the paper is arch-shaped in a view from the paper output direction, the curl of the paper in the paper output direction becomes small. As a result, even when the papers are output onto the output tray, the papers can be stacked without a problem.

When the position of the press rollers is adjusted individually, a minute adjustment can be carried out according to the feature of the curl of the paper. Even when a size or a thickness of the paper differs, the position of the press rollers can be adjusted easily according to the size or the thickness. In addition, an adjustment according to a paper transportation operation of the press rollers can be carried out easily. For example, in case of a duplex printing operation, the paper may be output once onto the output tray and a reversal transportation may be carried out to transport the paper into a reversal transportation path. In such a case, since a deformation of the paper for reinforcing the firmness of the paper may influence a subsequent transportation operation, it is necessary to prevent an excess firmness from being added to the paper. The press rollers of the image forming device according to a preferred aspect of the present invention can easily deal with such an adjustment.

The position adjusting member is provided to support the press rollers via the urging member which urges the press rollers against the output rollers. Accordingly, even when the press rollers are moved to adjust the position of the press rollers, the press rollers can be maintained making contact with the output rollers. In addition, even when the thickness of the paper changes, the press rollers are automatically set according to the thickness of the paper.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

A description will be made of preferred embodiments of the present invention. Although the preferred embodiments described hereinafter include various technical limitations, unless explicitly stated in the following description to limit the present invention, the present invention shall not be limited to the preferred embodiments described hereinafter.

Figure 1:
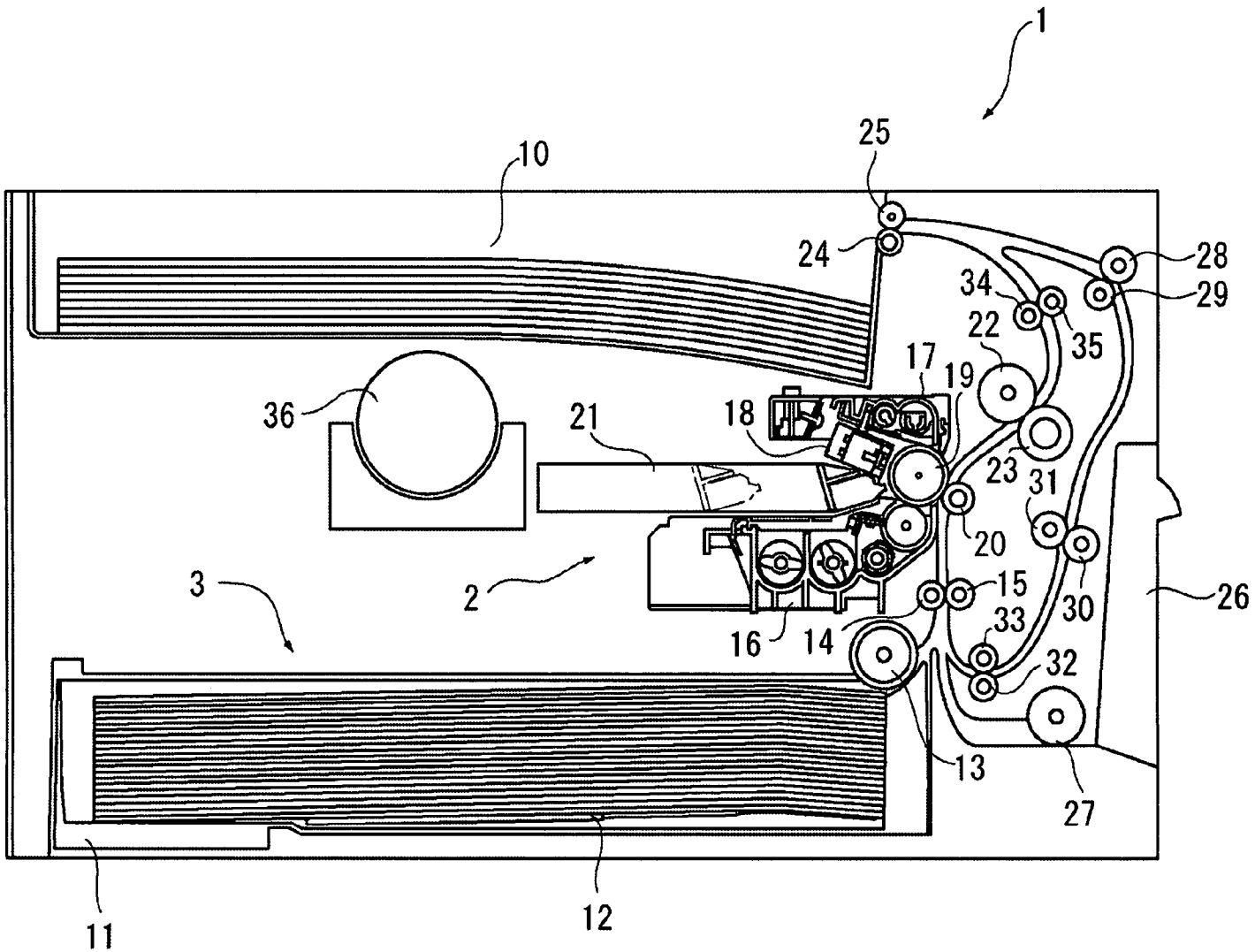
FIG. 1 is a schematic cross-sectional view illustrating the entire image forming device according to a preferred embodiment of the present invention.

FIG. 1 is a schematic cross-sectional view illustrating the entire image forming device according to a preferred embodiment of the present invention. An output tray 10 is arranged in an upper portion of an image forming device 1. A printer unit 2 and a paper feed unit 3 are arranged below the output tray 10.

The paper feed unit 3 includes a paper feed cassette 11. A plurality of prescribed-sized papers are stacked on a flapper 12. A pickup roller 13 is arranged at a right end portion of the paper feed cassette 11 in FIG. 1. The flapper 12 is urged upward by a spring member (not illustrated) so that an upper surface of the stacked papers makes contact with the pickup roller 13. When the pickup roller 13 is driven and rotates under such a state, the papers are fed into a paper transportation path one sheet at a time by a frictional force.

The fed paper is transported to the printer unit 2 by a feed roller 14 and a press roller 15. The printer unit 2 includes a developing unit 16, a cleaning mechanism 17, a corona charging unit 18, a photoconductive drum 19, a transfer roller 20, an exposing device 21, and a fixing roller 22 for printing onto the transported paper. The cleaning mechanism 17 uses a cleaning roller to clean the surface of the photoconductive drum 19 by trapping foreign substances, such as a remaining toner and a paper dust, adhered on the surface of the photoconductive drum 19 after an image is transferred onto the paper. The corona charging unit 18 uniformly charges the surface of the photoconductive drum 19 by a corona discharge from a discharge wire. The exposing device 21 exposes the uniformly charged photoconductive drum 19 according to an image printing signal. Accordingly, an electrostatic latent image is formed on the surface of the photoconductive drum 19. Then, the toner stored in the developing unit 16 is moved onto the electrostatic latent image and the electrostatic latent image is visualized. The transfer roller 20 is arranged at a position facing the photoconductive drum 19 across the paper. When a prescribed voltage is applied to the transfer roller 20, the toner image formed on the surface of the photoconductive drum 19 is transferred onto the paper. The transferred toner image is sandwiched between the fixing roller 22 and the press roller 23 to be heated and pressed. Accordingly, the toner image is fixed onto the paper. Then, the paper is transported to an output path by a feed roller 34 and a press roller 35. Subsequently, the paper is sandwiched between an output roller 24 and a press roller 25 and is output onto the output tray 10.

A manual feeding mechanism and a reversal transportation mechanism are provided on a side of a device main body of the image forming device 1. When carrying out a manual paper feeding, a side cover 26 is opened, and paper is inserted to a paper feed roller 27. The inserted paper is transported to the feed roller 14 and the press roller 15 by the paper feed roller 27, and a printing operation is performed. When carrying out a reversal transportation, after the printing operation is performed on a first side of the paper, the paper is sandwiched between the output roller 24 and the press roller 25, and a portion of the paper is output. Then, the output roller 24 rotates backward to transport the paper to a reversal transportation path. The paper is transported downward by two pairs of transportation rollers, i.e., a feed roller 28 and a press roller 20, and a feed roller 30 and a press roller 31. Then, the paper is transported upward by a feed roller 32 and a press roller 33, and transported by the feed roller 14 and the press roller 15 again. The printing operation is performed on a second side of the paper. Accordingly, both sides of the paper are printed. Moreover, a toner cartridge 36 accommodating the toner is inserted removably in a center portion of the image forming device 1. The toner accommodated in the toner cartridge 36 is replenished to the developing unit 16 through a channel (not illustrated).

Figure 2:
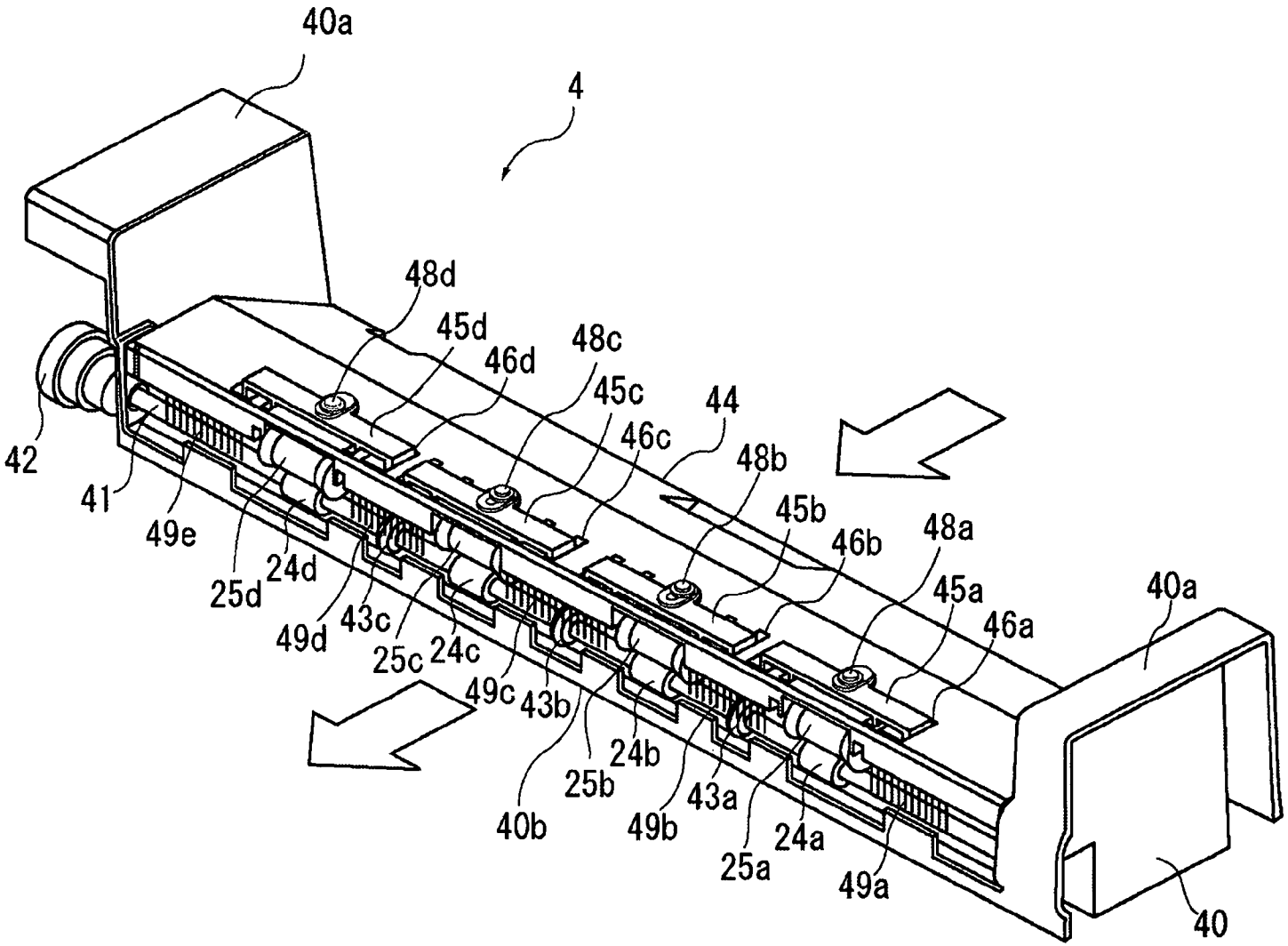
FIG. 2 is a perspective view illustrating a paper output mechanism.

FIG. 2 is a perspective view illustrating a paper output mechanism 4. A supporting frame 40 includes mounting portions 40*a* formed perpendicularly on both end portions of a guide portion 40*b*. The supporting frame 40 supports a rotational shaft 41 on which output rollers 24*a* through 24*d* are fixed. A driving gear 42 is fixed on one end portion of the rotational shaft 41. The driving gear 42 is driven and rotated by a drive transmitting mechanism (not illustrated). Pressing rollers 43*a* through 43*c* are fixed on the rotational shaft 41. More specifically, the pressing roller 43*a* is located at an intermediate position between the output roller 24*a* and the output roller 24*b*. The pressing roller 43*b* is located at an intermediate position between the output roller 24*b* and the output roller 24*c*. The pressing roller 43*c* is located at an intermediate position between the output roller 24*c* and the output roller 24*d*.

A guide cover 44 is fixedly mounted between the mounting portions 40*a* of the supporting frame 40. The guide cover 44 is arranged above the guide portion 40*b* with a prescribed interval therebetween. Supporting frame portions 45*a* through 45*d* are mounted on an end portion of the guide cover 44 so as to face the output rollers 24*a* through 24*d*, respectively. The supporting frame portions 45*a* through 45*d* support the press rollers 25*a* through 25*d*, respectively. The supporting frame portions 45*a* through 45*d* are fit and held in slits 46*a* through 46*d* formed through the guide cover 44, respectively.

Figure 3:
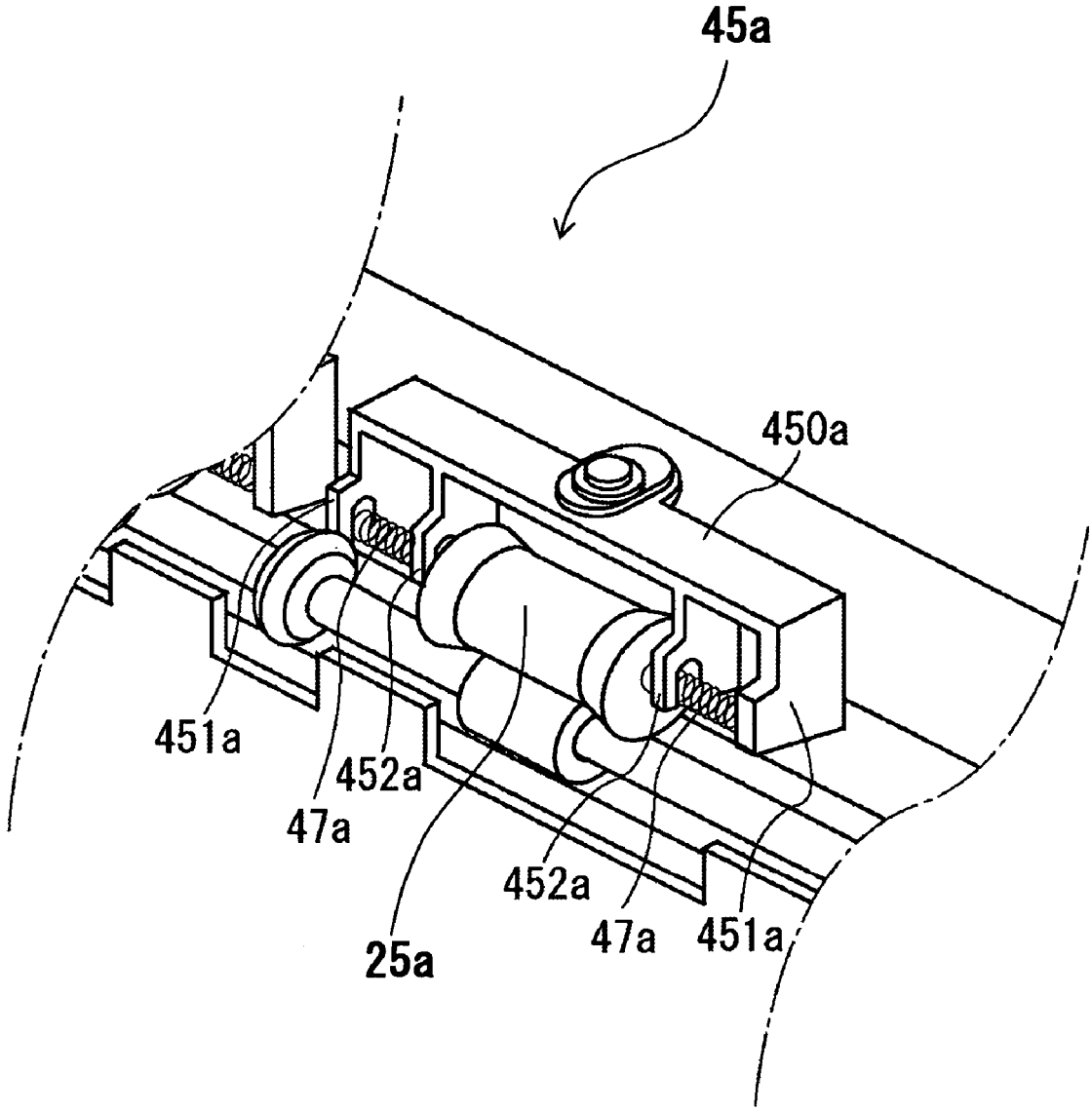
FIG. 3 is a partial enlarged perspective view of a supporting frame portion without a guide cover.

FIG. 3 is an enlarged perspective view of a portion of the supporting frame portion 45*a* under a state in which the guide cover 44 is not illustrated. The supporting frame portion 45*a* includes a main frame portion 450*a*, a pair of mounting frame portions 451*a*, and a pair of regulating portions 452*a*. The main frame portion 450*a* is located on an upper surface of the guide cover 44. The pair of the mounting frame portions 451*a* extends downward from both ends of the main frame portion 450*a*. The pair of the regulating portions 452*a* extends from the main frame portion 450*a* so as to sandwich the press roller 25*a* between the mounting frame portions 451*a* and 451*a*. A coil spring 47*a* is mounted between each mounting frame portion 451*a* and the press roller 25*a*. The coil springs 47*a* are engaged in the respective regulating portions 452*a* and are restricted from swinging. The press roller 25*a* is mounted rotatably on the coil springs 47*a*. The press roller 25*a* is pressed against the output roller 24*a* by an urging spring of the coil springs 47*a*. Further, the supporting frame portions 45*b* through 45*d* also have the same structure as the supporting frame portion 45*a* described above.

As illustrated by outlined arrows in FIG. 2, the paper is transported through the guide cover 44 and the guide portion 40*b*, and the paper is output by being sandwiched between the output rollers 24*a* through 24*d* and the press rollers 25*a* through 25*d*. The slits 46*a* through 46*d* formed through the guide cover 44 are formed along the paper output direction. The slits 46*a* through 46*d* are set longer than a width of the main frame portion of the supporting frame portions 45*a* through 45*d*. Therefore, the supporting frame portions 45*a* through 45*d* are held by the guide cover 44 so as to be movable in the paper output direction. The main frame portions are fixed on the guide cover 44 by setscrews 48*a* through 48*d*, respectively. Accordingly, the supporting frame portions 45*a* through 45*d* are positioned at a prescribed position in the paper output direction.

Charge eliminating brushes 49*a* through 49*e* are arranged on an edge of the guide cover 44 for removing static electricity from the paper. The charge eliminating brushes 49*a* through 49*e* are arranged in proximity of end portions of the press rollers 25*a* through 25*d*.

Figure 4:
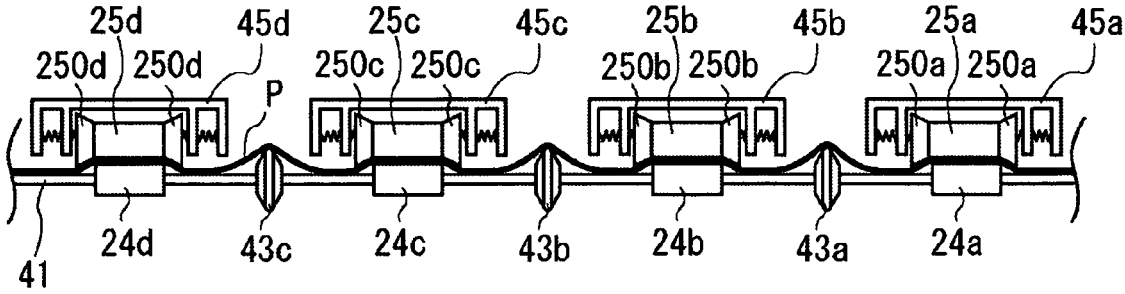
FIG. 4 illustrates a structure of rollers viewed from an output side in a paper output direction.

FIG. 4 illustrates a structure of rollers viewed from an output side of the paper output direction. Each of the press rollers 25*a* through 25*d* includes a center portion and end portions 250(*a-d*). The center portion makes contact with the respective output rollers 24*a* through 24*d*. An outer diameter of the end portions 250 gradually increases outward to form the press rollers 25*a* through 25*d* in a flange-shape. Accordingly, the paper sandwiched between the output roller 24(*a-d*) and the press roller 25(*a-d*) is curved in a direction approaching the rotational shaft 41 by the end portions 250(*a-d*) of each press roller 25(*a-d*). The paper is curved further in a direction departing from the rotational shaft 41 by each pressing roller 43(*a-d*). Accordingly, the paper bends like a wave, and firmness is provided to the entire paper.

Figure 5:
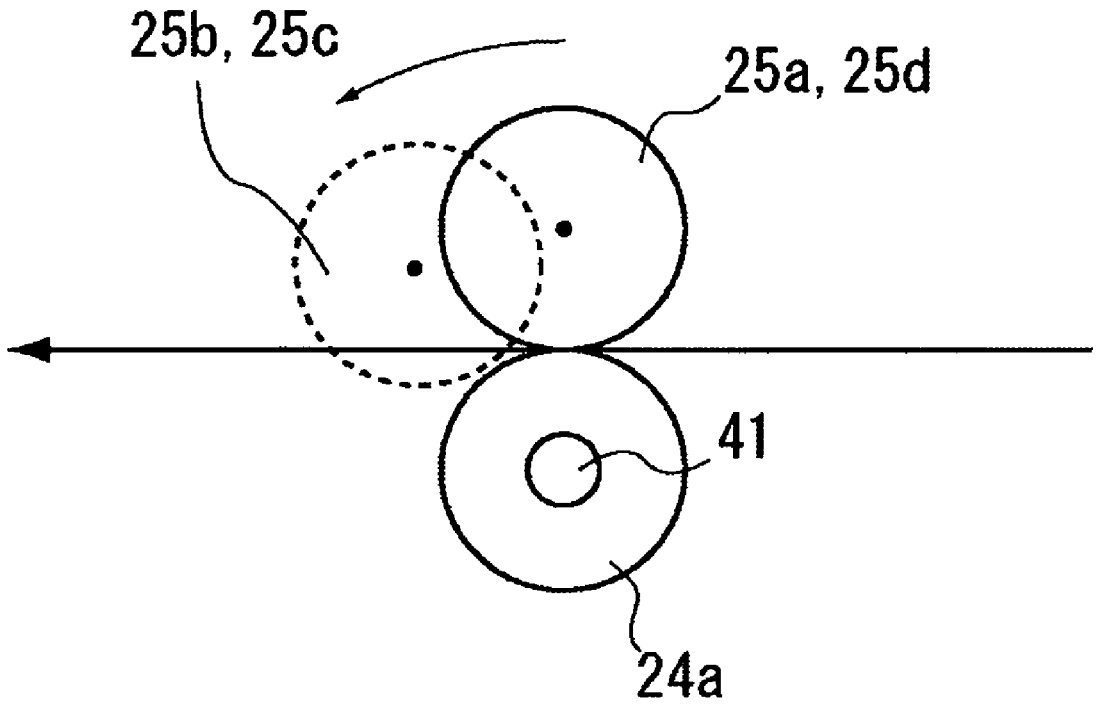
FIG. 5 illustrates a set position of a press roller viewed from an axial direction of a rotational shaft.

FIG. 5 illustrates a set position of the press rollers 25*a* through 25*d* viewed from an axial direction of the rotational shaft 41. In this example, the position of the press rollers 25*a* and 25*d* at both ends is set upstream in the paper output direction from the position of the remaining press rollers 25*b* and 25*c*. As illustrated in FIG. 2, the position of each of the press rollers 25*a* through 25*d* in the paper output direction can be set by moving the supporting frame portions 45*a* and 45*d* rearward in the paper output direction (i.e. against the direction of the arrows in FIG. 2) and moving the supporting frame portions 45*b* and 45*c* forward in the paper output direction (i.e in the direction of the arrows in FIG. 2). When the supporting frame portions 45*b* and 45*c* are moved forward in the paper output direction, the press rollers 25*b* and 25*c* also move forward. In this case, since the press rollers 25*a* through 25*d* are respectively urged towards the output rollers 24*a* through 24*d* by the coil springs 47, the press rollers 25*b* and 25*c* move under a state in which the press rollers 25*b* and 25*c* are pressed against the output rollers 24*b* and 24*c*. Accordingly, the press rollers 25*b* and 25*c* swing in a circumferential direction of the output rollers 24*b* and 24*c* and move in the paper output direction.

As described above, the press rollers arranged at both side edges of the paper are set to be located upstream in the paper output direction with respect to the remaining press rollers. Accordingly, the paper is output with the center portion of the paper being pulled slightly in the paper output direction compared with the sides of the paper. As a result, the firmness of the paper can be increased. Therefore, even when the paper curls while being transported, since the firmness of the paper is increased sufficiently, the paper can be output onto the output tray without curling. As a result, the output papers can be stacked under a preferable state. Further, the position of the supporting frame portions can be minutely adjusted while actually repeating a paper output test. Accordingly, the supporting frame portions can be positioned at an optimum position.

The optimum positioning can be selectively carried out by a user with respect to paper of a maximum usable size of the image forming device, paper of a most frequently-used size, or paper which is most likely to curl.

Figure 6:
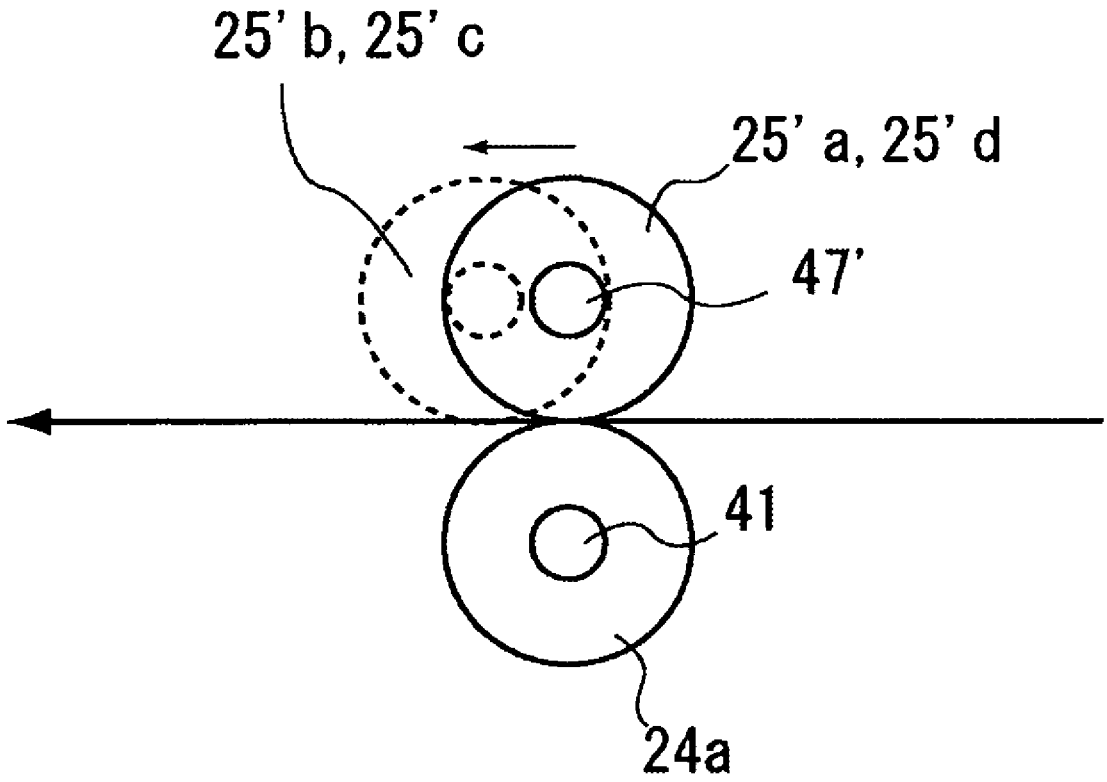
FIG. 6 illustrates a position adjusting member according to another preferred embodiment of the present invention.

In the above-described preferred embodiment, the position adjusting member comprises the slits formed on the guide cover, the supporting frame portions, and the coil springs. However, the present invention is not limited to the above-described example. For example, the position adjusting member may be another member also having a structure for individually moving each press roller in the paper output direction. For example, FIG. 6 illustrates a position adjusting member according to another preferred embodiment of the present invention. In this example, instead of providing the coil springs, each press roller 25' is fixed on a shaft 47', and each shaft 47' is mounted on a supporting frame portion via an elastic member (not illustrated). When the supporting frame portions move in the paper output direction, the press rollers move in the paper output direction as illustrated with dashed lines. Accordingly, a gap between the press rollers and the output rollers is minutely adjusted. As a result, a fine adjustment can be carried out according to the thickness of the paper.

As described above, by moving the supporting frame portions in the paper output direction and individually adjusting the position of the press rollers, a fine adjustment can be carried out according to the thickness of the paper in consideration of a usage of the user. For example, when frequently using small-sized papers, the supporting frame portions of the press rollers located at both side edges of the small paper may be adjusted to be located upstream in the paper output direction. An adjustment operation can be carried out easily according to the thickness of the paper. Although the firmness of the paper changes according to a material and/or a thickness of the paper, by carrying out a paper output test for predominantly-used papers and adjusting the position of the supporting frame portions, an optimum paper output operation can be performed according to the usage.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming device comprising:

a rotational shaft;

a plurality of output rollers fixed on the rotational shaft;

a plurality of press rollers respectively arranged opposing to the output rollers; and means for adjusting a position of the press rollers by moving the press rollers in a paper output direction, wherein the means for adjusting adjusts the press rollers arranged at both side edges of output paper to be located upstream in the paper output direction from remaining press rollers.

2. An image forming device comprising:

a rotational shaft;

a plurality of output rollers fixed on the rotational shaft;

a plurality of press rollers respectively arranged opposing to the output rollers;

means for adjusting a position of the press rollers by moving the press rollers in a paper output direction; and an urging member arranged to urge the press rollers against the output rollers, wherein the means for adjusting supports the press rollers via the urging member, wherein the means for adjusting adjusts the press rollers arranged at both side edges of output paper to be located upstream in the paper output direction from remaining press rollers.

3. An image forming device comprising:

a supporting frame including a guide portion and mounting portions formed perpendicularly from both ends of the guide portion;

a rotational shaft supported on the mounting portions;

a plurality of output rollers fixed on the rotational shaft;

a plurality of press rollers respectively arranged opposing to the output rollers;

means for adjusting a position of the press rollers by moving the press rollers in a paper output direction; and a plurality of supporting frame portions which are mounted on the guide cover and support the plurality of the press rollers, wherein the supporting frames are fit in slits formed on the guide cover.

4. The image forming device according to claim 3, wherein each of the supporting frame portions includes:

a main frame portion arranged on an upper surface of the guide cover, a pair of mounting frame portions extending downward from both sides of the main frame portion, and a pair of regulating portions extending from the main frame portion so as to sandwich the respective press rollers between the pair of the mounting frame portions.

5. The image forming device according to claim 4, further comprising coil springs respectively mounted between each of the mounting frame portions and each of the press rollers, wherein each of the coil springs is fit on each of the regulating portions and restricted from swinging.

6. The image forming device according to claim 5, wherein each of the press rollers is rotatably mounted on one end portion of each of the coil springs, and each of the press rollers is contacted against each of the output rollers by an urging force of each of the coil springs.

7. The image forming device according to claim 6, wherein each of the slits formed through the guide cover is formed along the paper output direction of the paper and is set longer than a width of the main frame portion of each of the supporting frame portions.

8. The image forming device according to claim 7, further comprising a charge eliminating brush arranged on a side edge of the guide cover between the press rollers to eliminate static electricity from the paper.

9. The image forming device according to claim 8, wherein a center portion of each of the press rollers makes contact with the respective output rollers, and an outer diameter of both end portions of each of the press rollers gradually increases outward to form the press rollers in a flange-shape.

* * * * *